United States Patent [19]

Bozek

[11] 3,961,722

[45] June 8, 1976

[54] CHILD RESISTANT EASY OPENING CLOSURE

[75] Inventor: John S. Bozek, Chicago, Ill.

[73] Assignee: Continental Can Company, Inc., New York, N.Y.

[22] Filed: Jan. 27, 1975

[21] Appl. No.: 544,151

[52] U.S. Cl. ..... 220/270

[51] Int. Cl.[2] ..... B65D 41/32

[58] Field of Search ..... 220/270, 271, 272, 273, 220/277, 269

[56] References Cited

UNITED STATES PATENTS

| | | | |
|---|---|---|---|
| 3,437,229 | 4/1969 | Khoury | 220/273 |
| 3,744,669 | 7/1973 | Coepen et al. | 220/270 |

*Primary Examiner*—George T. Hall

*Attorney, Agent, or Firm*—John J. Kowalik; Joseph E. Kerwin; William A. Dittmann

[57] ABSTRACT

A child-resistant safety pull tab having a score line lying along a diameter of the finger ring portion perpendicular to the axis of symmetry of the tab. Attempts to open the closure by lifting the end of the pull tab in the conventional manner merely result in the tab bending and ultimately yielding along the transverse score line.

In one preferred embodiment, two additional score lines are formed along substantially parallel chords of the finger ring portion straddling the axis of symmetry. The sides of the finger ring portion must be folded upwardly along the horizontal score lines to rigidify the tab before opening of the container may be accomplished.

In another preferred embodiment a reinforcing ring with a diametric weakening line is rotatably mounted on the finger ring portion of the pull tab. The reinforcing ring must be rotated until the reinforcing ring weakening line coincides with the finger ring weakening line, whereupon the reinforcing ring and the finger ring become mutually rigidifying and failure of the pull tab is prevented. In either embodiment, the additional operation, which runs counter to a child's prior experience renders removal of the closure beyond the capability of a young child.

29 Claims, 7 Drawing Figures

FIG. 4
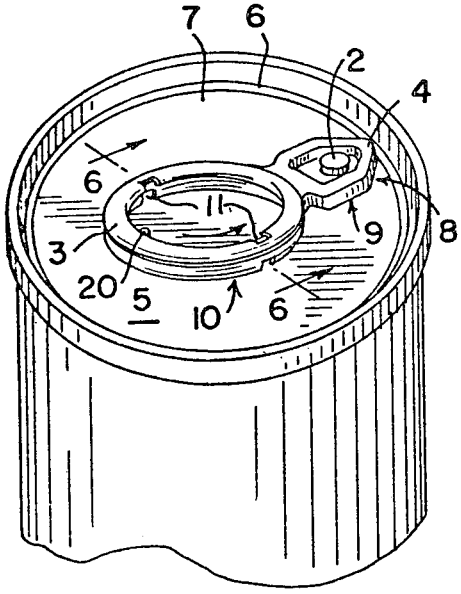
FIG. 5
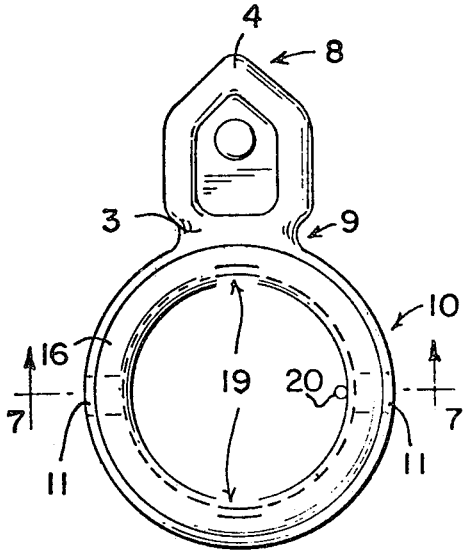
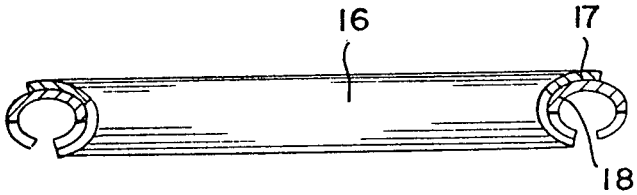
FIG. 6
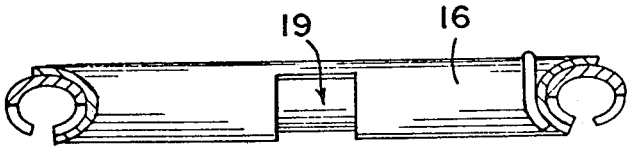
FIG. 7

CHILD RESISTANT EASY OPENING CLOSURE

SUMMARY OF THE INVENTION

It is well known that the accumulation of medicines and household chemicals commonly found in the home poses the threat of death or serious injury to small children. Storage of these materials in places supposedly beyond the reach of such children has not proven wholly satisfactory. It is, therefore, one of the important objects of the present invention to provide an improved safety or security closure for a standard easy-open container which may be readily removed by an adult but which will frustrate efforts of small children to open the container.

It is a further object to provide an improved security closure wherein the standard easy-open closure may be employed with a minimum of modification thereto; and more particularly it is an object to provide an improved child proof pull tab member combined with a conventional end panel to provide such a security closure.

BRIEF DESCRIPTION OF THE DRAWINGS

The various features and advantages of the security closure of this invention will be more apparent from the following detailed description when considered in connection with the accompanying drawing wherein:

FIG. 4 is a fragmentary top view of the top of a container having in association therewith a second embodiment of the present invention, illustrating the reinforcing ring in the secured position.

FIG. 5 is an enlarged top plane view of the pull tab.

FIG. 6 is an enlarged fragmentary cross-sectional view taken substantially along line 6—6 of FIG. 4, illustrating the reinforcing ring in the secured position.

FIG. 7 is an enlarged fragmentary cross-sectional view taken substantially along line 7—7 of FIG. 5 illustrating the reinforcing ring in the unsecured position.

DESCRIPTION OF THE FIRST PREFERRED EMBODIMENT (FIGS. 1–3)

Figure 1:
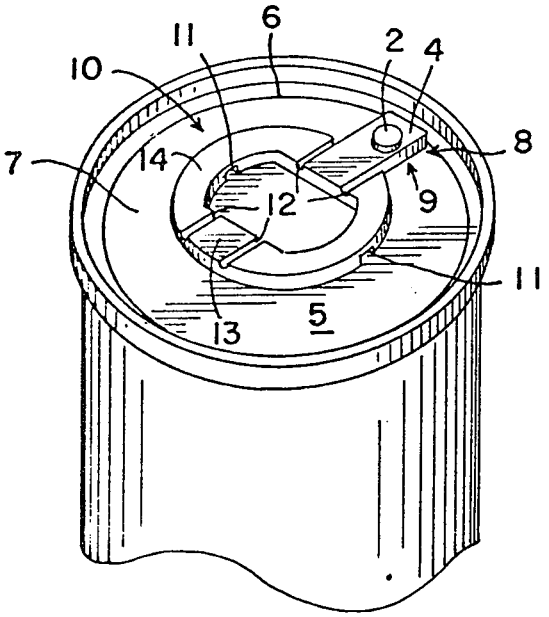
FIG. 1 is a perspective view of the upper portion of a container having in association therewith one embodiment of the present invention, illustrating the pull tab in the undeformed condition.

As shown in the drawings, the security closure of this invention includes an end panel 5, a pull tab 3 with integral piercing member 4, a rivet 2 fastening said pull tab 3 to said end panel 5 and an opening score line 6 formed in said end panel 5 and therein defining an opening flap 7. The pull tab 3 comprises a nose portion 8, an intermediate portion 9 and a substantially circular finger ring portion 10.

In the standard easy-open closure, opening is accomplished by vertically displacing the pull tab 3, thereby pivoting said pull tab 3 about the rivet 2 and impressing a downward force on the piercing member 4, said force resulting in the fracturing of the end panel 5 along the opening score line 6 beneath said piercing means 4. Continued upward displacement of said pull tab 3 results in controlled tearing of said end panel 5 along said opening score line 6. The opening flap 7 defined by said opening score line 6 is then removed by pulling the pull tab 3 thereby causing further tearing along the opening score line 6 until the opening flap 7 separates from the remainder of the end panel 5.

Figure 2:
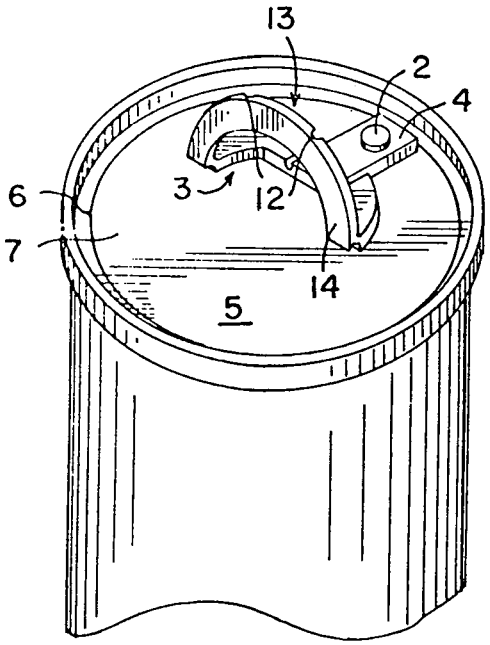
FIG. 2 is a view similar to FIG. 1, illustrating the end of the pull tab bent upwardly.

In the security closure of this invention, the pull tab 3 is formed with a transverse score line 11 and two longitudinal score lines 12. The transverse score line 11 is formed on the bottom surface 14 of the tab 3 along a diameter of the finger ring portion 10, perpendicular to the axis of symmetry of the tab 3. The two longitudinal score lines 12 are formed on the upper surface 15 of the tab 3 along substantially parallel chords of the finger ring portion 10 straddling the axis of symmetry of the tab 3. Attempts to open the closure by lifting the free end 13 of the finger ring portion 10 of the tab 3 result in the tab 3 bending along the transverse score line 11 without rupture of the opening score line 6 (FIG. 2). Continued pulling on the finger ring portion 10 results in the free end 13 breaking off along the transverse score line 11 thereby preventing further attempts to improperly open the container.

Figure 3:
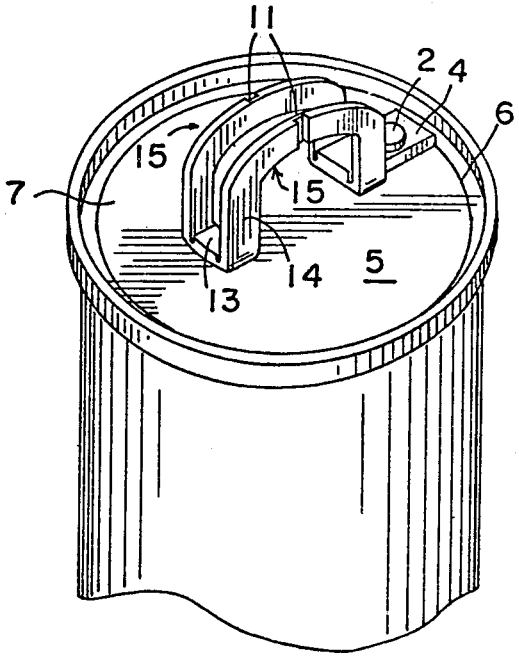
FIG. 3 is a view similar to FIG. 1, illustrating the sides of the pull tab folded upwardly.

To open the container, the sides 15 of the finger ring portion 10 must first be folded vertically along the longitudinal score lines 12. The folded configuration (FIG. 3) provides increased rigidity to the tab 3 and prevents bending or yielding along the transverse score line 11. Once the tab 3 is in the folded configuration, opening of the container may be accomplished in the usual manner by lifting, then pulling the tab 3.

DESCRIPTION OF THE SECOND PREFERRED EMBODIMENT (FIGS. 4–6)

The second preferred embodiment differs from the first in the manner or rigidifying the tab 3 for opening the container. The longitudinal score lines 12 are deleted. In their place, a circular opening in the finger ring portion 10. The reinforcing ring wall 17 is formed as an outwardly concave channel which co-operates with the ring wall 18 of the finger ring portion 10 to allow free rotation of the reinforcing ring 16 relative to the tab 3. A weakening score line 19 is formed along a diameter of the reinforcing ring 16 and a position indicator bar 20 is fastened to the reinforcing ring wall 17, 90° from the score line 19 end point.

When the reinforcing ring score line 19 is aligned with the finger ring score line 11 (FIG. 4) no appreciable increase in rigidity is afforded the tab 3. However, rotation of the reinforcing ring 16 to substantially misalign the score lines 11 and 19 (FIGS. 5 and 7) causes the finger ring portion 10 and the reinforcing ring 16 to become mutually rigidifying. Once the reinforcing ring 16 is in the misaligned position, opening of the container may be accomplished in the usual manner as described hereinabove.

The additional operation required to rigidify the tab 3 runs counter to the prior experience of the small child, thereby rendering opening of the closure beyond his capability. Further, an attempt to open the container improperly results in fracture of the tab 3 thereby rendering opening of the container more difficult and discouraging further tampering with the closure.

I claim:

1. An improved safety closure for use on a can or similar container comprising an end panel having a score defining an opening flap therein, a pull tab secured to said end panel, said pull tab comprising a nose portion and a finger grip portion, first means associated with the tab accommodating ineffective movement of said finger grip portion to open said flap, and second means selectively operable to render said first means ineffective and interrelating said portions of said tab to form a lever effective to open said flap, said second means being operable prior to movement of said finger grip portion.

2. An improved safety closure as defined in claim 1, wherein said first means comprises a score line formed in said tab effectuating collapse of said tab upon conventional manipulation thereof.

3. An improved safety closure as defined in claim 2, wherein said tab has an axis of symmetry, said score line lying along a chord of said finger ring portion perpendicular to the axis of symmetry of said tab.

4. An improved safety closure for use on a can or similar container comprising an end panel having a score defining an opening flap therein, a pull tab secured to said end panel and having means for fracturing said score to open said flap, means for reducing the rigidity of said tab to prevent opening of said flap through manipulation of said tab in the usual manner, and means for selectively rigidifying said tab for normal operational utility to open said container, said rigidity-reducing means comprising a score line formed in said tab effectuating collapse of said tab upon conventional manipulation prior to opening the container, said tab comprising a nose portion, an intermediate portion and a finger ring portion and having a line of symmetry, said rigidity-reducing score line lying along a chord of said finger ring portion substantially perpendicular to the axis of symmetry of said tab, said rigidifying means comprising two score lines formed in said tab and portions of said tab foldable along said two score lines to positions rigidifying said tab.

5. An improved safety closure as defined in claim 4, wherein said rigidifying score lines lie along chords of said finger ring portion straddling said axis of symmetry.

6. An improved safety closure as defined in claim 5, wherein said rigidifying score lines are formed in the outward surface of said tab.

7. An improved safety closure as defined in claim 6, wherein said rigidifying score lines are substantially parallel.

8. An improved safety closure as defined in claim 7, wherein said tab will fail along said rigidity reducing score line upon an attempt to open said closure in the usual manner.

9. A child-proof tab for opening a tear flap of a container end panel, said tab having a major axis and being relatively easily bendable into a first shape incapable of opening said flap, and means selectively operable while said major axis is substantially parallel to the plane of said end panel for reforming the tab into a second shape capable of opening said flap.

10. An improved safety closure for use on a can or similar container comprising an end panel having a score defining an opening flap therein, a pull tab secured to said end panel and having means for fracturing said score to open said flap, means for reducing the rigidity of said tab to prevent opening of said flap through manipulation of said tab in the usual manner, and means for selectively rigidifying said tab for normal operational utility to open said container, said rigidity-reducing means comprising a score line formed in said tab effectuating collapse of said tab upon conventional manipulation prior to opening the container, said tab comprising a nose portion, an intermediate portion and a finger ring portion and having a line of symmetry, said rigidity-reducing score line lying along a chord of said finger ring portion substantially perpendicular to the axis of symmetry of said tab, said rigidifying means comprising a reinforcing ring co-operatively engaging said finger ring.

11. An improved safety closure as defined in claim 10, wherein a weakening score line is formed along a chord of said reinforcing ring for selectively reducing the rigidity thereof.

12. An improved safety closure as defined in claim 11, wherein said reinforcing ring is rotatably attached to said finger ring portion.

13. An improved safety closure as defined in claim 12, wherein said reinforcing ring is rotatable between a first position wherein said reinforcing ring score line is substantially aligned with said finger ring portion rigidity reducing score line and a second position wherein said score lines are substantially out of alignment, said tab lacking substantial rigidity when said reinforcing ring is in said first position, said finger ring portion and said reinforcing ring co-operating for mutual rigidification when said reinforcing ring is in said second position.

14. An improved safety closure as defined in claim 13, and a position indicator fastened to said reinforcing ring.

15. An improved pull tab for use on an easy opening can or similar container comprising a nose portion, an intermediate portion and a finger ring portion, means for reducing the rigidity of said tab to prevent opening of said container through conventional manipulation of said tab, and means for selectively rigidifying said tab for normal operational utility prior to activation of said rigidity-reducing means to open said container.

16. An improved pull tab as defined in claim 15, wherein said rigidity reducing means comprises a score line formed in said tab effectuating collapse of said tab upon manipulation prior to opening said container.

17. An improved pull tab as defined in claim 16, wherein said rigidity-reducing score line lies along a chord of said finger ring portion substantially perpendicular to the axis of symmetry of said tab.

18. An improved pull tab for use on an easy opening can or similar container comprising a nose portion, an intermediate portion and a finger ring portion and having a line of symmetry, means for reducing the rigidity of said tab to prevent opening of said container through conventional manipulation of said tab, and means for selectively rigidifying said tab for normal operational utility to open said container, said rigidity-reducing means comprising a score line formed in said tab effectuating collapse of said tab upon manipulation of said tab prior to opening said container, said rigidity-reducing score line lying along a chord of said finger ring portion substantially perpendicular to the axis of symmetry of said tab, said rigidifying means comprising two score lines formed in said tab and portions of said tab foldable along said two score lines to positions rigidifying said tab.

19. An improved pull tab as defined in claim 18, wherein said rigidifying score lines lie along chords of said finger ring portion straddling said axis of symmetry.

20. An improved pull tab as defined in claim 19 wherein said rigidifying score lines are substantially parallel.

21. An improved pull tab as defined in claim 20, wherein said tab will fail along said rigidity reducing score line upon an attempt to open said container in the usual manner.

22. An improved pull tab as defined in claim 15, wherein said rigidifying means comprises a reinforcing ring co-operatively engaging said finger ring portion.

23. An improved pull tab as defined in claim 22, wherein a weakening score line is formed along a diameter of said reinforcing ring for selectively reducing the rigidity thereof.

24. An improved pull tab as defined in claim 23, wherein said reinforcing ring is rotatably attached to said finger ring portion.

25. An improved pull tab as defined in claim 24 wherein said reinforcing ring is rotatable between a first position wherein said reinforcing ring score line is substantially aligned with said finger ring portion rigidity reducing score line and a second position wherein said score lines are substantially out of alignment, said tab lacking substantial rigidity when said reinforcing ring is in said first position, said finger ring portion and said ring cooperating for mutual rigidification when said reinforcing ring is in said second position.

26. An improved pull tab as defined in claim 25, and a position indicator fastened to said reinforcing ring.

27. An improved pull tab as defined in claim 26, wherein said tab will fail along said rigidity reducing score line upon an attempt to open said closure while said reinforcing ring is in said first position.

28. A child-proof tab of the lever type comprising a flap-opening member normally bendable under a predetermined load and ineffective to open an associated flap, said tab having a major axis, said member having portions selectively displaceable while said major axis is substantially parallel to the plane of an associated end panel, to positions rigidifying said member into a configuration sufficient to transmit such flap opening loads.

29. An improved safety closure for use on a can or similar container comprising an openable end panel, a pull tab associated with said end panel, said pull tab having a lift portion for grasping and lifting said tab and opening said end panel, and first and second means associated with said lift portion, said first means rendering said lift portion inoperable to lift said pull tab, said second means selectively operable to condition said first means to a condition of inoperability and operative to condition said lift portion to a condition of operability to permit lifting of said tab.

* * * * *